US006499992B2

(12) United States Patent
Scheunpflug et al.

(10) Patent No.: US 6,499,992 B2
(45) Date of Patent: Dec. 31, 2002

(54) PLUG CONNECTION DEVICE, ESPECIALLY FOR EXTERIOR REARVIEW MIRRORS OF MOTOR VEHICLES

(75) Inventors: Thomas Scheunpflug, Ludwigsburg; Florin Secanu, Nürtingen, both of (DE)

(73) Assignee: Reitter & Schefenacker GmbH & Co. KG, Esslingen (DE)

( * ) Notice: Subject to any disclaimer, the term of this patent is extended or adjusted under 35 U.S.C. 154(b) by 0 days.

(21) Appl. No.: 09/963,996

(22) Filed: Sep. 26, 2001

(65) Prior Publication Data

US 2002/0039852 A1 Apr. 4, 2002

(30) Foreign Application Priority Data

Sep. 29, 2000 (DE) ..... 100 48 505

(51) Int. Cl.[7] ..... H01R 13/64; H01R 13/502; H01R 13/514

(52) U.S. Cl. ..... 431/247; 439/701

(58) Field of Search ..... 439/247, 557, 439/581, 540.1, 79, 78, 701, 246

(56) References Cited

U.S. PATENT DOCUMENTS 3,179,912 A * 4/1965 Huber et al. ..... 29/837
4,668,040 A * 5/1987 Matsuzaki et al. ..... 439/557
4,741,703 A * 5/1988 Johnescu et al. ..... 439/581
5,055,055 A * 10/1991 Bakker ..... 29/883
5,079,671 A * 1/1992 Garrett et al. ..... 361/600
5,083,926 A * 1/1992 Kissinger et al. ..... 411/501
5,199,896 A * 4/1993 Mosquera ..... 29/842
5,468,154 A * 11/1995 Yip et al. ..... 439/381
5,609,500 A * 3/1997 Holmes et al. ..... 439/540.1
5,639,249 A * 6/1997 Lenoir ..... 439/686
6,045,401 A * 4/2000 McAlonis ..... 439/540.1
6,068,509 A * 5/2000 Lin ..... 439/540.1
6,071,127 A * 6/2000 Acke et al. ..... 439/581
6,120,314 A * 9/2000 Harting et al. ..... 439/394
6,132,244 A * 10/2000 Leeman et al. ..... 439/541.5
6,164,977 A * 12/2000 Lester ..... 439/581
6,273,732 B1 * 8/2001 Johnescu et al. ..... 439/79
6,319,021 B1 * 11/2001 Billman ..... 439/78

* cited by examiner

*Primary Examiner*—P. Austin Bradley
*Assistant Examiner*—Edwin A. León
(74) *Attorney, Agent, or Firm*—Gudrun E. Huckett

(57) ABSTRACT

A plug connection device has a plug housing having at least one contact and a complementary plug having at least one complementary contact. At least one of the plug housing and the complementary plug is moveable relative to the other one in two directions when the plug housing and the complementary plug are inserted into one another. A plug holder is provided in which the plug housing is received. The plug holder has flexible portions to allow compensation movements of the plug holder together with the plug housing relative to the complementary plug to thereby align the plug holder, the plug housing, and the complementary plug with one another for proper insertion and contacting.

47 Claims, 8 Drawing Sheets

PLUG CONNECTION DEVICE, ESPECIALLY FOR EXTERIOR REARVIEW MIRRORS OF MOTOR VEHICLES

BACKGROUND OF THE INVENTION

1. Field of the Invention

The invention relates to a plug connection device, preferably for exterior rearview mirrors of motor vehicles, comprising a plug housing having at least one contact which can be inserted into a complementary plug having at least one complementary contact.

2. Description of the Related Art

Recently, it has become conventional to mount turn signal lights in the exterior rearview mirror of motor vehicles, and these turn signal lights must be supplied with the required electric current. For this purpose, in the exterior rearview mirror a plug connection device is provided which is comprised of a plug housing and a complementary plug. Both components must be plugged into one another when mounting the exterior rearview mirror in order to provide the lighting device of the turn signal light with the required current. Often, these components must be inserted into one another "blind", i.e., without the laborer being able to see the components. This means that the proper contacting after plugging in can no longer be inspected from the exterior by the laborer. Accordingly, it happens frequently that the complementary plug and the plug housing are not inserted properly into one another, in particular, when these two components are not properly aligned with one another.

SUMMARY OF THE INVENTION

It is an object of the present invention to configure the plug connection device of the aforementioned kind such that a proper and reliable contacting can be achieved when inserting or plugging in the two components, even when the components are not precisely aligned with one another.

In accordance with the present invention, this is achieved in that the plug housing and/or the complementary plug are movable relative to one another during insertion or plugging in.

Since the plug housing and/or the complementary plug of the plug connection device according to the invention can be moved relative to one another during insertion or plugging in, the components can be inserted into one another reliably even when they are not precisely aligned with one another. As a result of the movability of the plug housing and/or of the complementary plug it is thus ensured that even for a "blind" assembly the two components can be inserted into one another reliably. The plug connection device according to the invention is used advantageously for exterior rearview mirrors of motor vehicles, but, of course, can also be used in any situation where contacting by insertion of two components of a plug connection device is required.

An especially advantageous solution results when a plug holder, which receives the plug housing, is provided and secures the contact within the plug housing against displacement when connecting the plug housing and the complementary plug. This ensures that the contact is not pushed by the complementary contact of the complementary plug out of the plug housing during insertion which then would prevent contacting. This securing function ensures that the contact(s) in the plug housing cannot be moved out of the plug housing during insertion into one another.

DESCRIPTION OF THE PREFERRED EMBODIMENTS

The plug connection device according to the invention makes it possible to contact the complementary plug and a plug holder with a plug housing connected thereto in a reliable manner to one another, even when these components are not precisely aligned with one another. Accordingly, the plug holder and the complementary plug can be inserted or plugged into one another "blind" in a reliable fashion, i.e., without these components being visible to the laborer.

Figure 1:
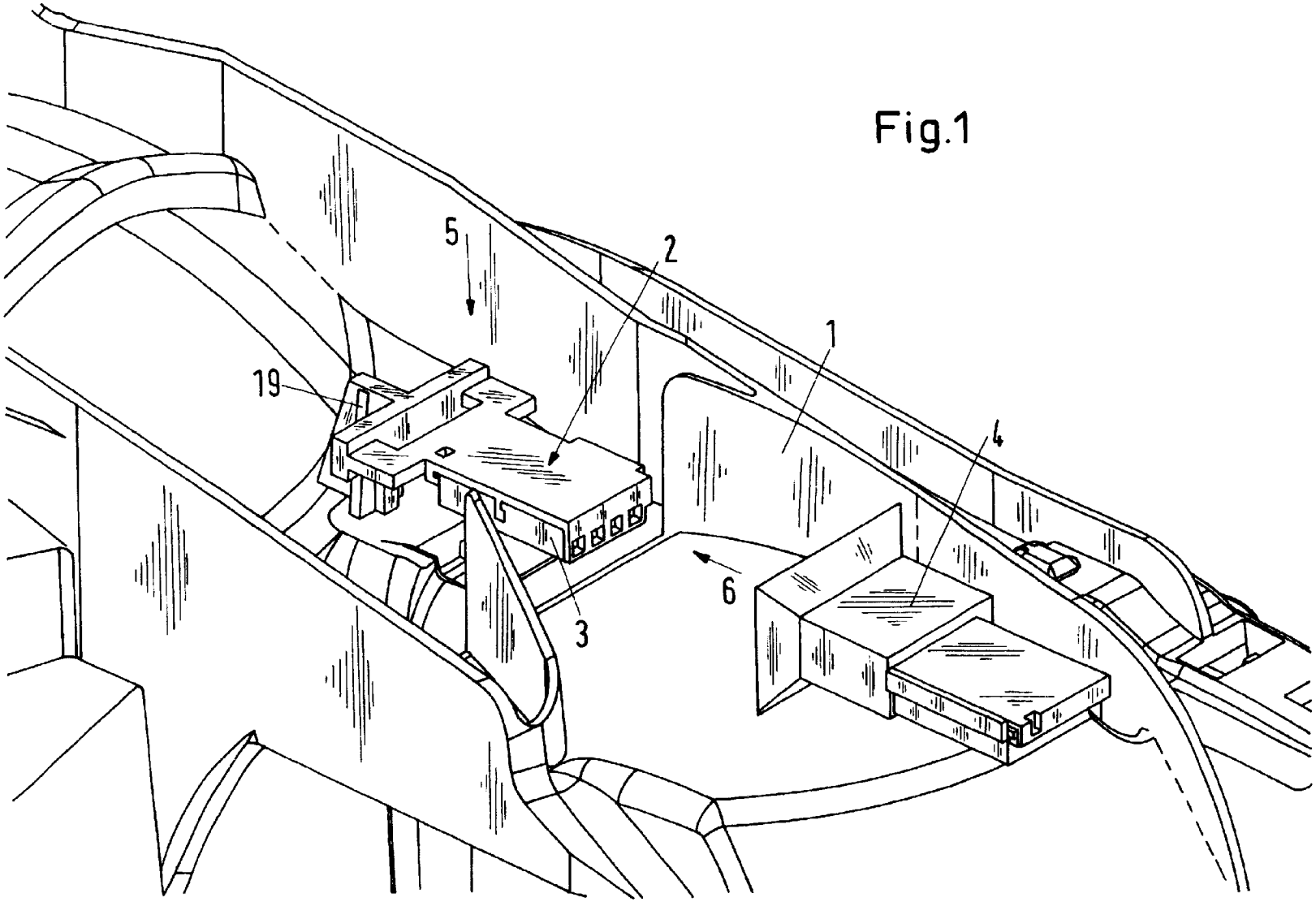
FIG. 1 is a perspective illustration of a plug connection device arranged in a mirror housing.

The plug connection device is inserted into a mirror housing 1 of an exterior rearview mirror of a motor vehicle and has a plug holder 2 which receives a plug housing 3 and which is to be connected to a complementary plug 4. In FIG. 1, only the support of the mirror housing 1 is illustrated. The plug holder 2 is inserted in the mounting direction 5 into its mounting position in the mirror housing 1 while the complementary plug 4 is placed or pushed onto the plug holder 2 in the plug-in direction 6. In order for the plug holder 2 and the complementary plug 4 to be reliably plugged into one another, even when the two parts are not precisely aligned with one another, the plug holder 2 is moveable to a limited extent in the mounted position.

Figure 2:
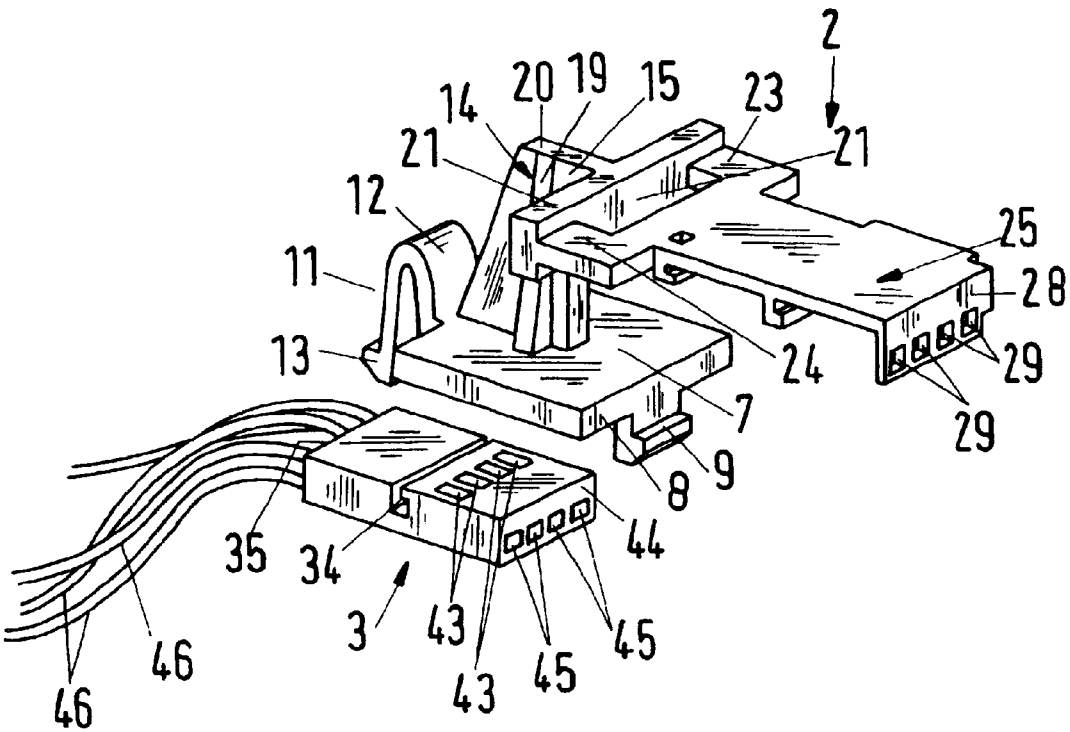
FIG. 2 is a perspective illustration of a plug holder and a plug housing of the plug connection device according to the invention before being attached to one another.

The plug holder 2 has a plate-shaped base member 7 (FIG. 2) which has a rectangular cross-section. A locking hook 9 projects from a narrow side 8 of the base member 7 and is advantageously a monolithic part of the base member 7. The locking hook 9 is positioned at half the length of the narrow side 8 and snaps into place in a corresponding mounting opening of the mirror housing 1.

Figure 6A:
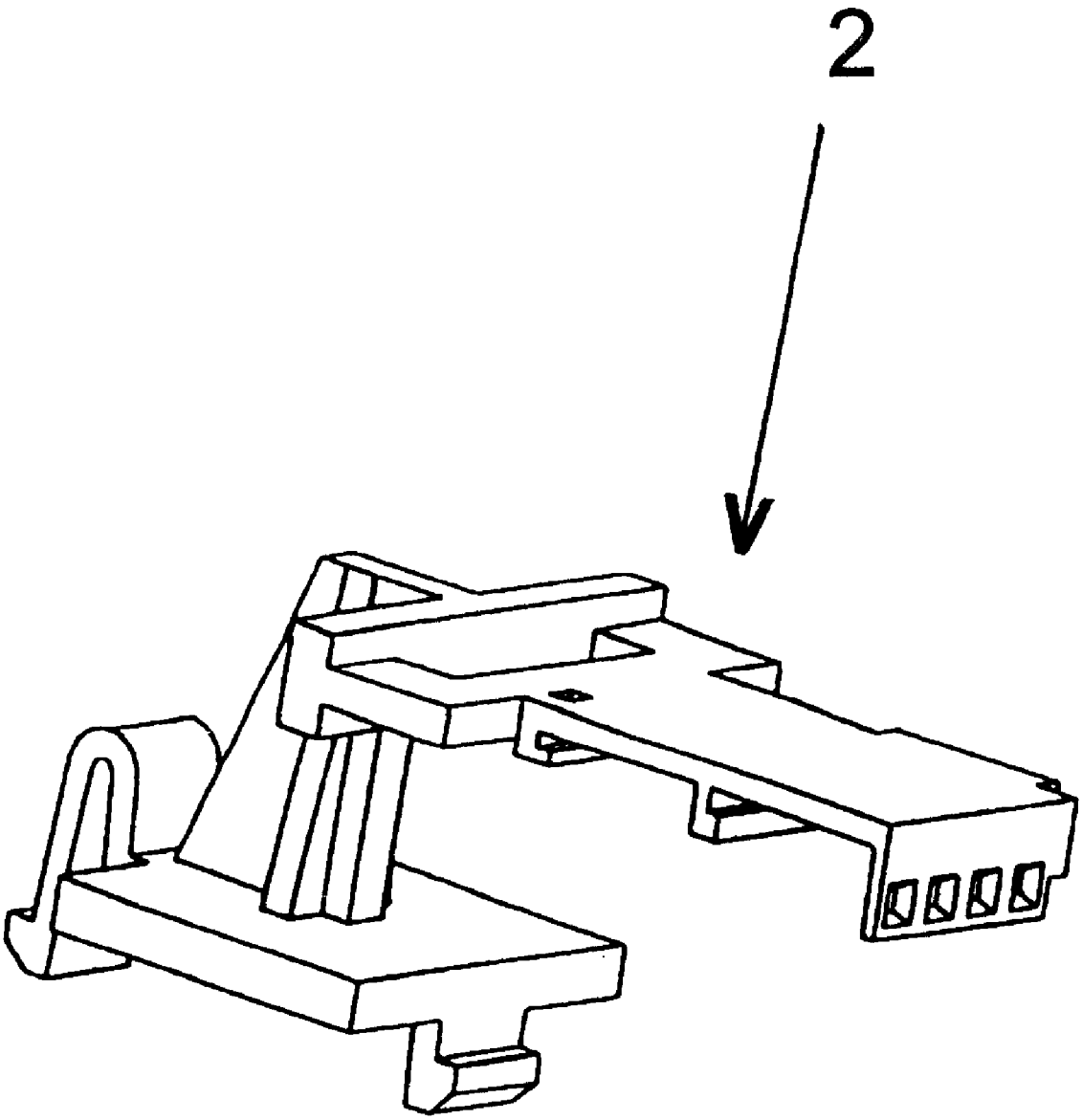
FIG. 6*a* is a perspective view of the plug holder of FIG. 4.

At the opposite narrow side 10 of the base member 7 a further locking element 11 is provided which is also arranged at half the length of the narrow side and is advantageously a monolithic part of the base member 7. The locking element 11 has a bent portion 12 which is curved like a hairpin and extends from the narrow side 10 upwardly past the plane of the base member 7 and then, with an arc shape extends downwardly to the opposite side of the base member 7. At the free end, the bent portion 12 is provided with a locking nose 13 which in the illustrated embodiment is positioned at the same level as the locking nose of the locking hook 9. Depending on the configuration of the mounting location, the two locking noses of the locking elements 9, 11 can also be positioned at different levels. When mounting the plug holder 2, the bent portion 12 is first elastically compressed until the locking nose 13 reaches a corresponding locking opening of the mirror housing 1. Then the bent portion 12 springs back so that the locking nose 13 engages underneath the edge of the locking opening. In this way, the plug holder 2 can be mounted in a simple way within the mirror housing 1. For removing the plug holder 2, it is only necessary to compress the bent portion 12 of the locking element 11 so that the locking nose 13 will be released from the edge of the locking opening. The plug holder 2 can then be easily removed from the mirror housing 1. The general configuration of the plug holder can be seen best in FIG. 6*a*.

Figure 4:
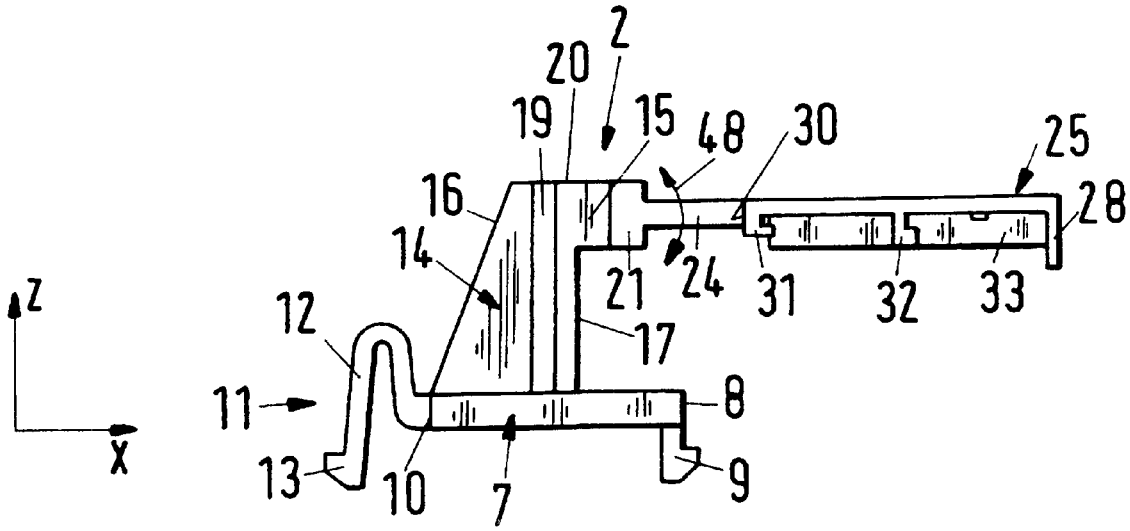
FIG. 4 is a side view of the plug holder of a plug connection device according to the invention.

A brace 14 projects perpendicularly from the base member 7 at a side facing away from the locking nose 13. The brace 14 is of a trapezoidal shape, when viewed in a side view, and is provided at half the width of the base member 7. It extends parallel to the longitudinal sides of the base member 7. At the upper end area, the brace 14 is extended by an elastically bendable or flexible portion 15, which is of a rectangular shape in a side view (FIG. 4) and is positioned in the same plane as the brace 14. The portion 15 and the brace 14 are advantageously formed as a monolithic part together with the base member 7. As is illustrated in FIG. 4, the portion 15 is positioned at a spacing from the base member 7.

The brace 14 tapers from the base member 7 in the direction toward its free end. The edge 16 facing the locking element 11 ends at the level of the narrow side 10 of the base member 7. The oppositely positioned edge 17 of the brace 14 is positioned at a spacing from the narrow side 8 of the base member 7 and extends perpendicularly to the upper side of the base member 7. In the area between the two edges 16 and 17 of the brace 14, transverse braces 18 and 19 adjoin both lateral sides of the brace 14 and extend from the upper side of the base member 7 to the upper planar edge 20 of the brace 14. The two transverse braces 18, 19 are triangular in an end view (FIGS. 1 and 2), respectively, and taper from the base member 7 in the direction toward the edge 20 of the brace 14. The transverse braces 18, 19 are configured such that their width, measured perpendicularly to the brace 14, is zero at the edge 20 of the brace 14 (see FIG. 1).

Figure 5:
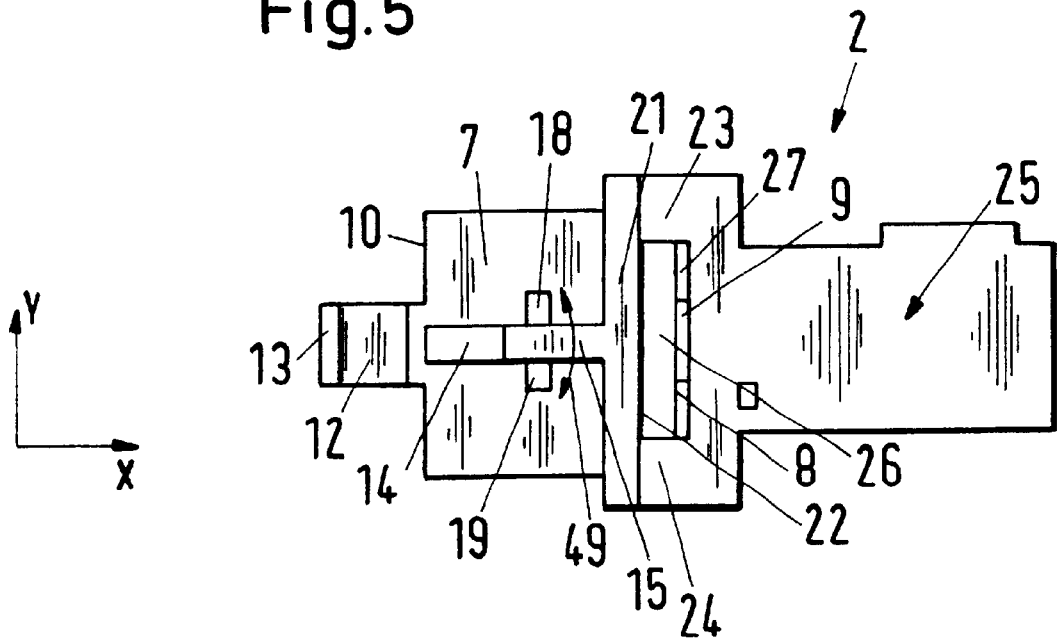
FIG. 5 is a top plan view of the plug holder according to FIG. 4.

A transverse stay 21 adjoins the end face of the extension portion 15 and extends perpendicularly thereto. The transverse stay 21 has the same height as the portion 15 and, in a plan view according to FIG. 5, projects past both longitudinal sides of the base member 7. The transverse stay 21 has a constant width and height across its length.

A support member 25 is connected by means of bending sections in the form of parallel legs 23, 24 to the end face 22 of the transverse stay 21 facing away from the brace 14. The support member 25 and the legs 23, 24 are advantageously formed as a monolithic part and the legs 23, 24, in turn, are advantageously formed as a monolithic part together with the transverse stay 21. The legs 23, 24 adjoin the transverse stay 21 at half its height. The legs 23, 24 delimit a rectangular opening 26 which is delimited also by the end face 22 of the transverse stay 21 and the oppositely positioned edge 27 of the support member 25 extending parallel to the transverse stay 21. The support member 25 is substantially plate-shaped and provided at its free end with a transverse stay 28 connected perpendicularly thereto. The transverse stay 28 projects away from the support member 25 in a direction to toward the base member 7 and is provided with openings 29 (FIG. 2) through which the contacts (not illustrated) of the complementary plug 4 project in the plugged-in position.

On the opposite edge 30 and approximately at half the length of the support member 25, two L-shaped guide members 31 and 32 are provided which extend across the width of the support member 25 parallel to one another and to the transverse stay 28. The guide members 31, 32 project from the same side of the support member 25 as the transverse stay 28. As illustrated in FIG. 4, the guide member 32 projects farther down from the support member 25 than the guide member 31. The transverse stay 28, in turn, project past the guide member 32.

The legs 23, 24 project, when viewed in a plan view, past the narrow side 8 of the base member 7 so that the support member 25, viewed in a plan view, is positioned adjacent to the base member 7. A longitudinal wall 33 (FIG. 4), extending parallel to the longitudinal side of the support member 25, connects one end of the guide members 31, 32 and the transverse stay 28 to one another and forms a stop for the insertion of the plug housing 3 into the plug holder 2.

Figure 6B:
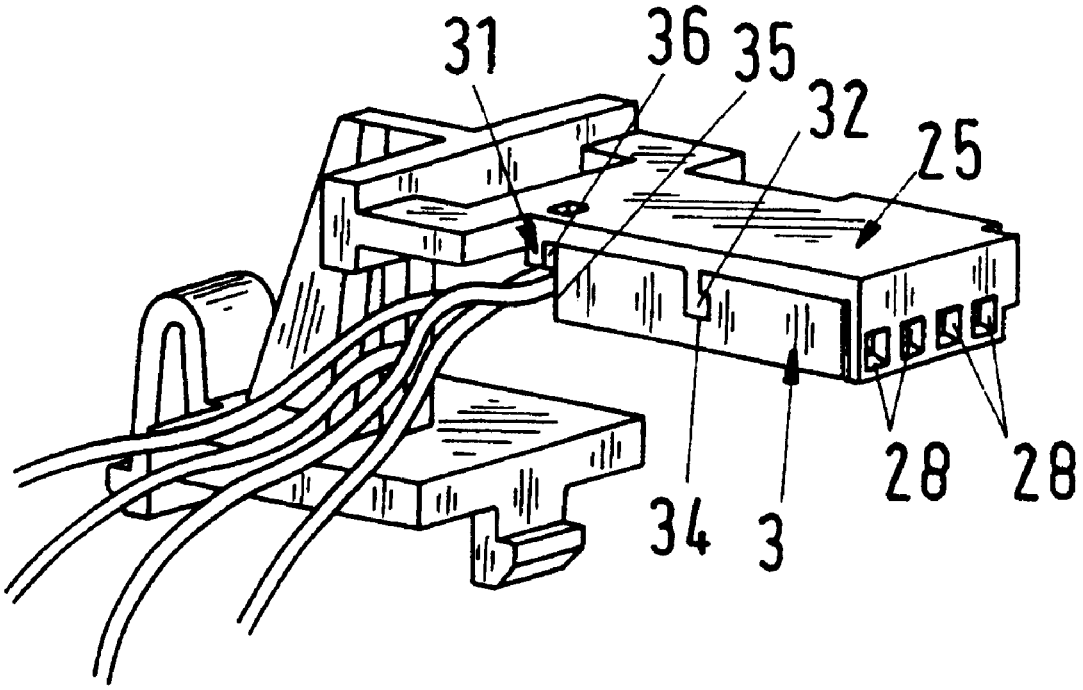
FIG. 6*b* is a perspective view of the plug holder of FIG. 4 with the plug housing inserted therein.
Figure 7:
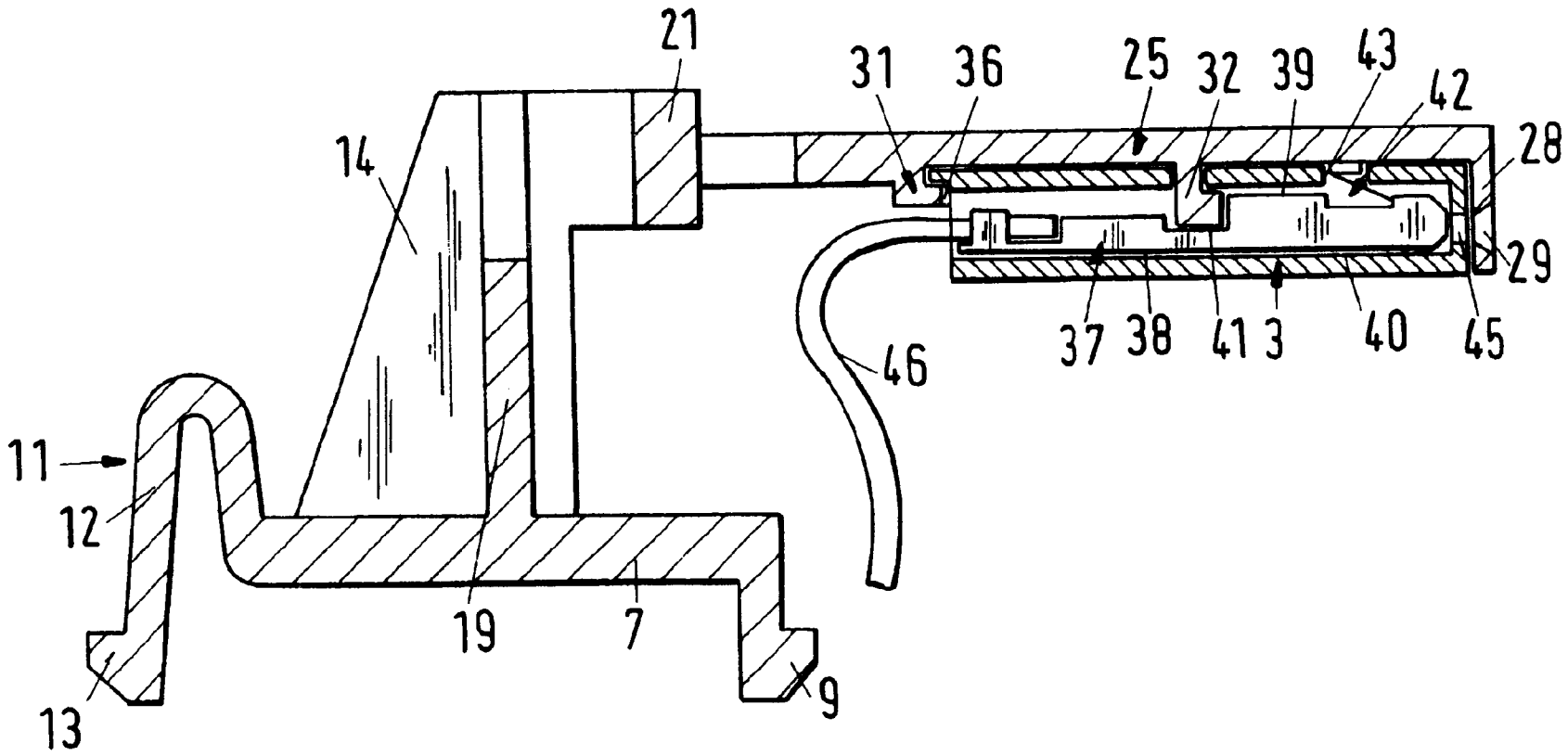
FIG. 7 shows a section of the plug holder with inserted plug housing according to FIG. 6*b* on an enlarged scale.

The plug housing 3 is of a parallelepipedal shape and has at one side an L-shaped recess or cutout 34 (FIG. 2) which is engaged by the guide member 32 of the support member 25 in a positive-locking way. Moreover, the plug housing 3 in the mounted positioned rests with one of its narrow sides 35 at the free end of the short leg 36 of the guide member 31 (FIG. 6*b* and FIG. 7).

In the plug housing 3 contacts in the form of contact jacks 37 (only one being shown in FIG. 7) are positioned adjacent to one another. These contact jacks 37 are locked in their position by means of the guide member 32 so that, when plugging in the complementary plug 4, they are not pushed out of the plug housing 3 by the contacts of the complementary plug. The contact jacks 37 are square or rectangular in cross-section and have two oppositely positioned sidewalls 38, 39, wherein the sidewall 38 extends straight and rests against the bottom 40 of the plug housing 3. The other sidewall 39, positioned at a spacing to the sidewall 38, has a U-shaped deformation 41 which is engaged by the guide member 32 of the support member 25 thus acting as a securing member. As a result of the U-shaped configuration of this deformation 41, the contact jack 37 is secured properly in its longitudinal direction against displacement within the plug housing 3. In the area between the guide member 32 and the transverse stay 28 of the support member 25, the sidewall 39 is provided, as is known in the art, with a slanted, outwardly bent tongue 42 which engages corresponding openings 43 in the side of the plug housing 3 provided with the recess or cutout 34. The tongues 42 are slanted counter to the insertion direction of the contact jacks 37 at a slant to the rear so that they provide an additional locking function for the contact jacks 37.

The end face 44 of the plug housing 3, which in the mounted position is located adjacent to the transverse stay 28 of the support member 25, is provided with openings 45 (FIG. 2 and FIG. 7) which are aligned with the openings 29 in the transverse stay 28. The openings 29 are advantageously conically tapered in the insertion direction of the contacts of the complementary plug 4 (FIG. 7) so that plugging the plug holder 2 and the complementary plug 4 into one another is facilitated. Advantageously, the thickness of the plug housing 3 corresponds to the height of the transverse stay 28 (FIG. 7) so that the plug housing 3 is substantially protected within the plug holder 2 when inserted therein.

Electric lines 46 are connected to the contact jacks 37 and project outwardly from the end face 35 of the plug housing 3.

Figure 3:
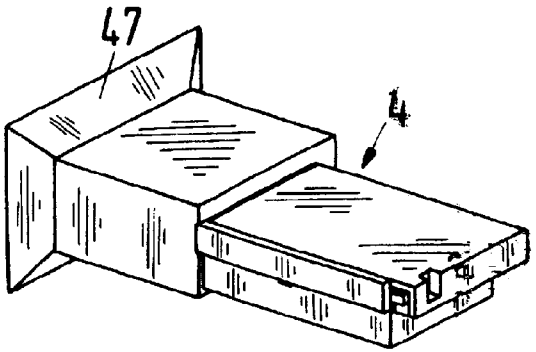
FIG. 3 is a perspective illustration of the complementary plug of the plug connection device according to the invention.

The complementary plug 4 in the mounted position is rigidly connected within the mirror housing 1 and has an insertion funnel 47 (FIG. 3) at its end face facing the plug holder 2. The funnel 47 widens in the direction of the plug holder 2. Within this insertion funnel 47 the contacts (not illustrated) are provided which, when connecting the plug housing 3 received in the plug holder 2 and the plug 4, engage the openings 29, 45 of the plug holder 2 and the plug housing 3.

Since the support member 25 is articulated like a universal joint, it can align itself relative to the complementary plug 4 if it has not been aligned properly beforehand. The legs 23, 24, with which the support member 25 is secured on the transverse stay 21, are configured with regard to their thickness such that in the direction of double arrow 48 (FIG. 4) they can be elastically bent in the X-Z plane. Moreover, the transverse stay 21 can be elastically bent in the direction of the double arrow 49 (FIG. 5) in the X-Y plane. This is achieved in that the transverse stay 21 is connected to the narrow extension portion 15 of the brace 14. This portion 15 is so thin that it can be elastically bent by the required amount. The imaginary bending axis of the portion 15 is perpendicular to the base member 7 while the imaginary bending axis of the elastically bendable or flexible legs 23, 24 is parallel to the upper side of the base member 7 and perpendicular to the imaginary bending axis of the portion 15. As a result of the two bending possibilities in directions perpendicular to one another, the plug holder 2 can be moved by means of the complementary plug 4 during insertion into its optimal position even when the plug holder 2 and the complementary plug 4 are not precisely aligned with one another.

Moreover, the plug holder 2 is formed by means of the guide member 32 such that during insertion of the plug holder 2 and the complementary plug 4 into one another the contact jacks 37 are locked within the plug housing 3 and cannot be pushed accidentally out of the plug housing 3. The plug holder 2 has thus a double function in that, on the one hand, it can perform the described compensation movements and, on the other hand, it can provide a secondary locking action for the contact jacks 37.

Figure 8:
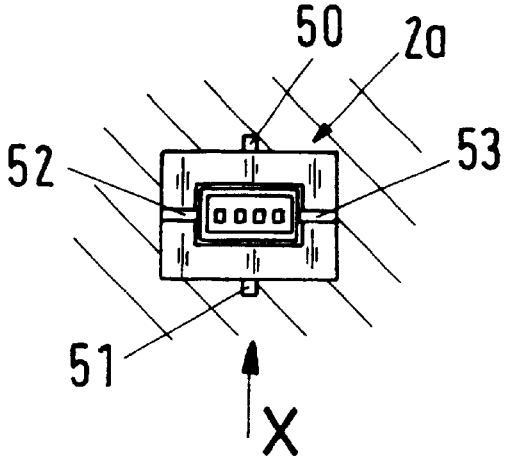
FIG. 8 is an end view of a second embodiment of a plug holder.
Figure 10:
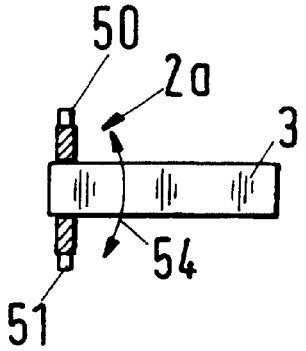
FIG. 10 shows partially in section and partially in a side view the plug holder according to FIG. 8.
Figure 9:
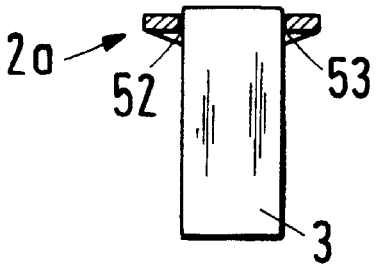
FIG. 9 shows partially in section and partially in a top plan view the plug holder according to FIG. 8.
Figure 11:
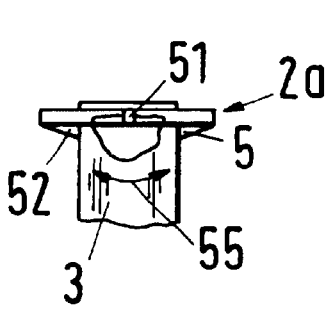
FIG. 11 shows a view in the direction of arrow X of FIG. 8.

FIGS. 8 through 11 show a plug holder 2*a* which is of a ring shape and surrounds the plug housing 3 at one end. The plug holder 2*a* as illustrated in FIG. 8, has a rectangular shape and is provided at two oppositely positioned longitudinal sides with a bearing pin 50, 51, respectively, with which the plug holder 2*a* can be pivoted. The two bearing pins 50, 51 are aligned with one another coaxially and form a common pivot axis for the plug holder 2*a*.

The plug housing 3 projects with one end slightly past the plug holder 2*a* (FIG. 9 to FIG. 11) which is in the form of a rectangular ring member. The plug housing 3 is connected by means of two connecting stays 52, 53 with the plug holder 2*a*. The two connecting stays 52, 53 are aligned coaxially with one another and are located at half the width of the narrow sides of the rectangular plug holder 2*a*. They are positioned perpendicularly to the plane of the ring member (2*a*). The connecting stays 52, 53 form elastically bendable or flexible portions and enable the plug housing 3 to pivot in the direction of double arrow 54 in FIG. 11, whereby the connecting stays 52, 53 are elastically bent. Since, moreover, the plug holder 2*a* together with the plug housing 3 can perform compensating movements about the axis of the bearing pins 50, 51 (arrow 55 in FIG. 11), an optimal alignment of the plug holder 2*a* and the plug housing 3 relative to the complementary plug 4 (FIG. 1) during insertion is ensured also with this embodiment. While in the above described first embodiment the two pivot possibilities 48, 49 of the plug holder 2 are realized by elastic deformation of parts of the plug holder 2, only the compensation movement 54 is realized by the elastic deformation of the connecting stays 52, 53 in the embodiment according to FIGS. 8 to 11. The other compensation possibility 55 is provided by the pivotable support of the plug holder 2*a* by means of the bearing pins 50, 51. They are positioned transversely or at an angle, preferably perpendicularly, to the connecting stays 52, 53 so that in this way compensation movements of the plug holder 2*a* are also provided in two directions perpendicular to one another in this second embodiment. In other respects, this second embodiment is identical to the embodiment according to FIGS. 1 through 7.

Figure 12:
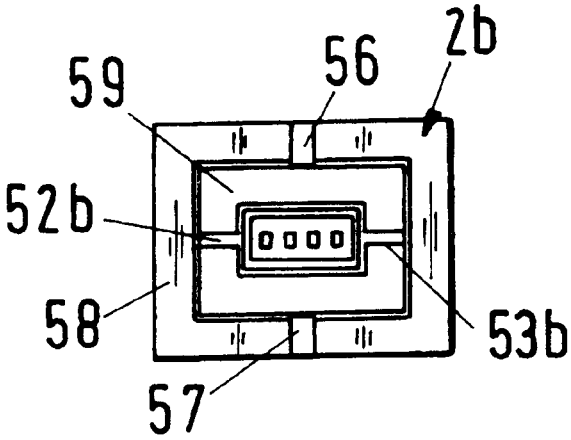
FIG. 12 shows an end view of a third embodiment of a plug holder of the plug connection device according to the invention.
Figure 13:
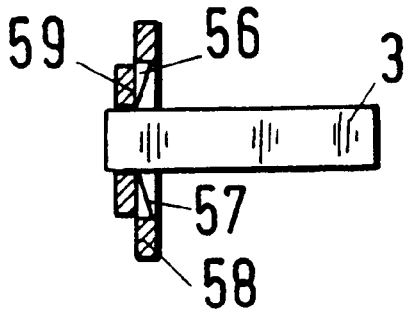
FIG. 13 shows partially in section and partially in a side view the plug holder according to FIG. 12.
Figure 14:
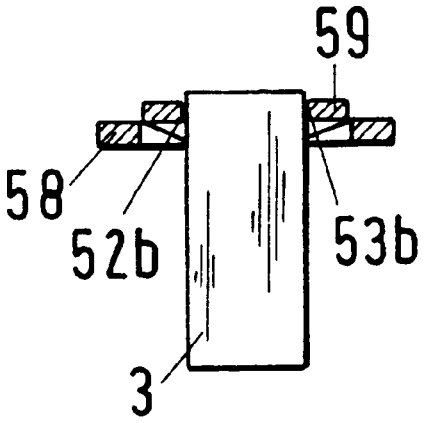
FIG. 14 shows partially in section and partially in a top plan view the plug holder according to FIG. 12.

In the embodiment according to FIG. 12 through FIG. 14, the plug holder 2*b* is comprised of rectangular ring members which surround the plug housing 3 in the vicinity of one of its ends. It projects slightly with one end past the plug holder 2*b* (FIG. 13 and FIG. 14). The plug holder 2*b* is provided with first flexible portions in the form of two aligned stays 56, 57 which connect an outer ring member 58 of the plug holder 2*b* in an articulated way with an inner ring member 59 of the plug holder 2*b*. Both ring members 58, 59 are rectangular (FIG. 12). The inner ring member 59 has a smaller cross-section than the outer ring member 58 which, relative to the axis of the plug housing 3, is staggered relative to the inner ring member 59 (FIGS. 13 and 14). The stays 56, 57 are provided at half the length at both longitudinal sides of the outer ring member 58 and are positioned perpendicularly to the respective ring plane.

The inner ring member 59 is provided with second flexible portions in the form of stays 52*b*, 53*b* with which the inner ring member 59 is fastened on the plug housing 3. The stays 52*b*, 53*b* are positioned aligned to one another and transversely or at an angle, preferably perpendicularly, to the stays 56, 57. The inner ring member 59 surrounds the plug housing 3 and rests against its mantle surface. The stays 52*b*, 53*b* are provided at have the length of the narrow sides of the rectangular inner ring member 59 (FIG. 12).

The stays 52*b*, 53*b* and 56, 57 form elastically bendable or flexible portions in the form of film hinges which enable compensation movements of the plug housing 3 in directions perpendicular to one another. The stays, as in the preceding embodiment, are so thin that the plug housing 3 can perform the required movements in case that it is not properly aligned relative to the complementary plug 4 (FIG. 1). The stays 52*b*, 53*b* and 56, 57 are triangular in cross-section (FIG. 13 and FIG. 14) and have across their length the same thickness, respectively. This ensures that these stays, on the one hand, provide a secure connection of the ring members 58, 59 with one another as well as a connection of the inner ring member 59 with the plug housing 3. In spite of this, these stays allow because of their flexibility the required compensation movements of the plug housing 3.

With the described embodiments of the plug connection device, the complementary plug 4 and the plug housing 3 can be inserted or plugged into one another "blind", i.e., without the laborer being able to see the two components, because the plug holder 2, 2*a*, 2*b*, even for an improper alignment of the plug housing 3 and the complementary plug 4, can be reliably and precisely connected with the complementary plug 4 by carrying out corresponding compensation movements.

While specific embodiments of the invention have been shown and described in detail to illustrate the inventive principles, it will be understood that the invention may be embodied otherwise without departing from such principles.

What is claimed is:

1. A plug connection device comprising:

a plug housing (3) having at least one contact (37);

a complementary plug (4) having at least one complementary contact;

wherein at least one of the plug housing (3) and the complementary plug (4) is moveable relative to the other one when the plug housing (3) and the complementary plug (4) are inserted into one another;

a plug holder (2) wherein the plug housing (3) is received in the plug holder (2);

wherein the plug holder (2) secures the at least one contact (37) of the plug housing (3) against displacement when the plug housing (3) and the complementary plug (4) are inserted into one another;

wherein the plug holder (2) has at least one securing member (32) configured to secure the contact (37) against displacement;

wherein the plug holder (2) has a base member (7) and wherein the at least one securing member (32) is connected to the base member (7) and projects away from the base member (7);

wherein the at least one securing member (32) forms a guide member for the plug housing (3) and wherein the base member (7) has an additional guide member (31) for the plug housing (3).

2. The plug connection device according to claim 1, wherein at least one of the plug housing (3) and the complementary plug (4) is moveable relative to the other in two directions, wherein the directions are positioned angularly to one another.

3. The plug connection device according to claim 1, wherein the two directions are positioned at a right angle to one another.

4. The plug connection device according to claim 1, wherein the plug housing (3) is moveably arranged.

5. The plug connection device according to claim 1, wherein the plug holder (2) has flexible portions (15, 23, 24).

6. The plug connection device according to claim 1, wherein the plug housing (3) has at least one cutout (34) configured to allow passage of the at least one securing member (32).

7. The plug connection device according to claim 1, wherein the at least one contact (37) is a contact jack having an engagement portion (41) configured to engage the at least one securing member (32).

8. The plug connection device according to claim 1, wherein the at least one securing member (32) is provided on the support member (25).

9. The plug connection device according to claim 1, wherein the at least one securing member (32) forms a guide member for the plug housing (3) when the plug housing (3) is inserted into the plug holder (2).

10. The plug connection device according to claim 1, wherein the at least one securing member (32) is has an L-shaped cross-section.

11. The plug connection device according to claim 1, wherein the plug holder (2) is configured to be detachable.

12. The plug connection device according to claim 11, wherein the plug holder (2) has two locking elements (9, 11).

13. The plug connection device according to claim 12, wherein the plug holder (2) has a base member (7) and wherein the locking elements (9, 11) are connected to the base member (7).

14. The plug connection device according to claim 13, wherein the plug holder (2) comprises at least one brace (14) and wherein the brace (14) is connected to the base member (7) and projects away from the base member (7).

15. The plug connection device according to claim 14, wherein the plug holder (2) comprises a support member (25) pivotably connected to the brace (14).

16. The plug connection device according to claim 15, wherein the plug housing (3) is secured on the support member.

17. The plug connection device according to claim 15, wherein the plug holder (2) has an elastically bendable portion (15) attached to the brace (14) and wherein the support member (15) is connected to the elastically bendable portion (15).

18. The plug connection device according to claim 17, wherein the brace (14), the elastically bendable portion (15), and the support member (25) are formed as a monolithic part.

19. The plug connection device according to claim 17, wherein the support member (25) has at least one bending section (23, 24) and a transverse stay (21) connected to the at least one bending section (23, 24).

20. The plug connection device according to claim 19, wherein the transverse stay (21) is connected to two of the bending sections (23, 24).

21. The plug connection device according to claim 19, wherein the transverse stay (21), the two bending sections (23, 24), and the support member (25) are formed as a monolithic part.

22. The plug connection device according to claim 19, wherein the at least one bending section (23, 24) is elastically bendable in a direction transverse to the elastically bendable portion (15).

23. A plug connection device comprising:

a plug housing (3) having at least one contact (37);

a complementary plug (4) having at least one complementary contact;

wherein at least one of the plug housing (3) and the complementary plug (4) is moveable relative to the other one when the plug housing (3) and the complementary plug (4) are inserted into one another;

a plug holder (2*a*) wherein the plug housing (3) is received in the plug holder (2*a*); and wherein the plug holder (2*a*) is a ring member configured to receive the plug housing (3) and to be pivotable.

24. The plug connection device according to claim 23, wherein the plug holder (2*a*) has two bearing pins (50, 51) coaxially aligned with one another.

25. The plug connection device according to claim 23, wherein the ring member is rectangular.

26. The plug connection device according to claim 23, wherein at least one of the plug housing (3) and the complementary plug (4) is moveable relative to the other in two directions, wherein the directions are positioned angularly to one another.

27. The plug connection device according to claim 23, wherein the two directions are positioned at a right angle to one another.

28. The plug connection device according to claim 23, wherein the plug housing (3) is moveably arranged.

29. The plug connection device according to claim 23, wherein the plug holder (2*a*) has flexible portions (52, 53).

30. The plug connection device according to claim 23, wherein the plug holder (2*a*) is configured to be detachable.

31. The plug connection device according to claim 23, wherein the plug holder (2*a*) has at least one bearing pin (50, 51).

32. The plug connection device according to claim 31, wherein the plug housing (3) and the plug holder (2*a*) are connected to one another by elastically bendable stays (52, 53).

33. The plug connection device according to claim 32, wherein the stays (52, 53) are aligned with one another and are positioned transversely to the at least one bearing pin (50, 51).

34. The plug connection device according to claim 32, wherein the stays (52, 53) are positioned perpendicularly to a plane of the ring member.

35. A plug connection device comprising:

a plug housing (3) having at least one contact (37);

a complementary plug (4) having at least one complementary contact;

wherein at least one of the plug housing (3) and the complementary plug (4) is moveable relative to the other one when the plug housing (3) and the complementary plug (4) are inserted into one another;

a plug holder (2*b*) wherein the plug housing (3) is received in the plug holder (2*b*); and wherein the plug holder (2*b*) has a first ring member and a second ring member (58, 59), wherein the first ring member (58) is articulated on the second ring member (59) by first flexible portions (56, 57), and wherein the second ring member (59) is articulated on the plug housing (3) by second flexible portions (52*b*, 53*b*).

36. The plug connection device according to claim 35, wherein the second flexible portions (52*b*, 53*b*) are coaxially aligned with one another.

37. The plug connection device according to claim 35, wherein the first and second flexible portions (52*b*, 53*b*; 56, 57) are positioned transversely relative to one another.

38. The plug connection device according to claim 35, wherein the first and second flexible portions (52*b*, 53*b*; 56, 57) and the first and second ring members (58, 59) are formed as a monolithic part.

39. The plug connection device according to claim 35, wherein the first and second ring members (58, 59) are staggered relative to one another in a longitudinal direction of the plug housing (3).

40. The plug connection device according to claim 35, wherein the first and second ring members (58, 59) are rectangular.

41. The plug connection device according to claim 35, wherein the first and second flexible portions (52*b*, 53*b*; 56, 57) are stays positioned perpendicularly to a plane of the first and second ring members (58, 59).

42. The plug connection device according to claim 35, wherein at least one of the plug housing (3) and the complementary plug (4) is moveable relative to the other in two directions, wherein the directions are positioned angularly to one another.

43. The plug connection device according to claim 35, wherein the two directions are positioned at a right angle to one another.

44. The plug connection device according to claim 35, wherein the plug housing (3) is moveably arranged.

45. The plug connection device according to claim 35, wherein the plug holder (2*b*) has flexible portions (52*b*, 53*b*, 56, 57).

46. The plug connection device according to claim 35, wherein the first flexible portions (56, 57) are coaxially aligned with one another.

47. The plug connection device according to claim 46, wherein the plug holder (2*b*) is configured to be detachable.

* * * * *